United States Patent [19]

Hartz

[11] 4,068,608

[45] Jan. 17, 1978

[54] CABLE STOPPER

[75] Inventor: Peter Hartz, Langen, Germany

[73] Assignee: Aktien-Gesellschaft "Weser", Bremen, Germany

[21] Appl. No.: 659,856

[22] Filed: Feb. 20, 1976

[30] Foreign Application Priority Data

Feb. 28, 1975 Germany ..... 2508764

[51] Int. Cl.[2] ..... B63B 21/08

[52] U.S. Cl. ..... 114/199; 24/136 R; 24/263 CA; 188/65.2; 294/114; 403/369; 403/374

[58] Field of Search ..... 114/199; 188/65.1, 65.2, 188/67; 403/374, 369; 294/101, 114; 24/263 CA, 263 DL, 136 R, 115 M, 115 N; 254/156

[56] References Cited

U.S. PATENT DOCUMENTS

| | | | |
|---|---|---|---|
| 370,744 | 9/1887 | Mixer | 24/263 CA |
| 639,520 | 12/1899 | Carpenter | 114/199 |
| 1,048,928 | 12/1912 | Aster et al. | 403/369 |
| 2,106,373 | 1/1938 | Garriott | 294/114 |
| 2,245,592 | 6/1941 | Jones | 24/263 CA |
| 2,288,977 | 7/1942 | Sibble | 24/263 CA |

FOREIGN PATENT DOCUMENTS

| | | | |
|---|---|---|---|
| 2,114,569 | 3/1972 | Germany | 24/136 R |

*Primary Examiner*—Trygve M. Blix
*Assistant Examiner*—Charles E. Frankfort
*Attorney, Agent, or Firm*—Michael J. Striker

[57] ABSTRACT

A device for clamping and stopping elongated objects. The device encompasses a passage adapted to receive at least a section of an elongated object to be stopped.

20 Claims, 3 Drawing Figures

CABLE STOPPER

BACKGROUND OF THE INVENTION

The invention relates to a device adapted to clamp and stop the motion of an elongated object of any type which object is inserted into and is led through the device. In a specific embodiment, the invention relates to a stopper of cables. This cable stopper is adapted to prevent release of a cable behind a desired length thereof. Cable, as mentioned herein is to be understood to be, for instance a cable used for tying to one another two objects, or a cord, a rope and the like which is dispensed in desired lengths and is to be detained in a predetermined position. However, a cable in the spirit of the invention also may be an electrical cable which is to be laid into a trench dug for collocation therein as an underground cable, or a submarine cable gradually released into water in synchronism with the motion of the slip releasing it towards the e.g. sea bottom.

In the pertinent prior art, there have been known cable stoppers capable of temporarily detaining cables, especially for a short period and/or for intercepting togging cables, anchoring cables and the like on decks of ships, on off-shore pillars in harbors, on pier poles and similar facilities.

The cable stoppers known hitherto include a two-part clamping housing. The housing of these known cable stoppers is positioned in axial alignment with the cable whose motion is to be restrained. The housing clamping parts may be opened for inserting therebetween a cable and may be clamped together for detaining the cable inserted therebetween. A pivotable clampable detent is provided to keep both the housing parts in closed condition. Also this clamping detent is positioned in axial alignment parallel to the inserted cable and is mounted on one of the housing parts and pivotable thereupon. This detent is equipped with an extension on which it may be ensured in engaging position by a simple shiftable catching arrestor which is coupled by means of a chain or the like with the other housing part.

Each of the housing parts includes a clamping jaw. One of these jaws is fixed immovably to the housing part carrying it, and the other jaw is at least partially movable on the other housing part on which it is mounted. This movability of one of the jaws permits adjusting the stopper to cables of different thicknesses.

However, this adjustment is very limited only, so that it is necessary to provide individual cable stoppers for cables having different diameters.

When the cable stopper of this type is to be opened, first the catching arrestor is to be withdrawn to cause the clamping detent to rise and unlock the connection between the housing parts. Thereafter, the housing parts may be moved from one another in order to free the cable.

The operation of this type of a clamping stopper housing is extremely dangerous, due to the pulling forces involved. In reality, a safe operation is possible only, when the cable has become unstrained or when the strain it experiences is small.

The known cable stoppers also are provided with suspending means, being mostly in the form of a pair of chain tugs. One chain tug at one end thereof is usually attached to one of the housing parts. The other ends of the chain tugs are affixed to a ring on which the cable stopper is anchored on the deck of a ship, on a pier pole and the like.

In the prior art, stretching devices have been known utilizable for tightening wires of very small diameters, such as those having the thickness of under 10 mm. These devices are provided with clamping jaws mounted on a plate. The jaws are configurated and located so that they abut conically positioned projections on the plate. Moreover, these jaws are connected to levers via articulated interconnecting means. These levers are arranged to abut holding means also provided on the plate. This holding means also includes for instance chain tugs, cords and the like. These stretching devices have various drawbacks and inconveniences. So, for instance, it is characteristic for these devices that the pulling forces imparted by the holding means affect the clamping jaws via levers and that these jaws compress the wire inserted from the open side of the device. Due thereto, the wire is often damaged, mutilated and the like. In view of this possible inconvenience, devices of this type are not utilizable for serving as cable stoppers for the purpose the invention has in mind. These devices also are open on one side, this being a further shortcoming thereof, since if they were used in a form adapted to stop cables, the latter could slip out or could be squeezed partially only and either slide or be mutilated.

SUMMARY OF THE INVENTION

It is an object of the present invention to overcome the inconveniences and shortcomings connected with the known devices arranged to stop and detain elongated objects and keep them in a desired position.

It is thus an object of the present invention to provide a device to clamp and stop an elongated object inserted into and led through the mentioned device and to detain it in a desired position.

It is a specific object of the present invention to provide a device of the type alluded to herein above which is in the form of a cable stopper and is equipped with clamping jaws efficient to keep the cable inserted therebetween in a desired stop condition.

Still another object of the present invention is to provide such a cable stopper in which the clamping jaws may be operated without any danger also in case the cable they keep in a desired position is fully loaded and stretched.

A concomitant object of the present invention is to provide the above described cable stopper which is arranged to be operable from a distant place.

Yet another object of the present invention is to provide a cable stopper of the above indicated type, wherein a pair of opposite clampable jaws is arranged in such a relationship to one another that the jaws are capable to receive therebetween and then keep in position cables of various diameters.

A further object of the present invention is to provide a cable stopper having the above discussed properties and advantages, wherein the clamping jaws are located inside, and are encompassed in their both open and closed conditions by, a casing which casing has over and underneath the clamping jaws, respectively, a top and a bottom wall which walls align a cable inserted between the jaws in a manner such that the cable is engaged by the same throughout its entire thickness, and is prevented from slipping out of the jaws to the one or the other side thereof.

A further object of the present invention is to provide a cable stopper of a compact construction by forming for the clamping jaws a casing covering the clamping jaws from above and beneath, respectively, by a top and a bottom wall, and from either side by a side wall positioned so that each of the clamping jaws engages on the side remote from its clamping area its corresponding side wall.

Yet another object of the present invention is to provide a cable stopper of the structure depicted herein above, wherein each of the pair of the clamping jaws is configurated so that, when these jaws are shifted inwardly, they take a position wherein they constantly have their surfaces devised to contact and squeeze a cable substantially parallel to one another and thus are enabled to engage a cable along their entire lengths.

An additional object of the present invention is to provide a cable stopper of the above described type whose casing has a trapezoidal configuration, is bounded by a top and a bottom wall spaced from one another by elongated rectangular side walls and having at its wide lower and its narrow apex sides an aperture for passage of a cable to be engaged between the clamping jaws.

It is another object of the invention to provide a cable stopper having a trapezoidal configuration and having located inside this casing a pair of opposite clamping jaws slidable therein and having each the form of a right-angled triangular body bounded by a base edge, a slanting distal edge parallel to the adjacent casing side wall and an inward edge extending at right angle from the base edge, wherein these inward edges extend parallel to one another, so that each of the jaws, when being shifted, slides on its distal side edge along the adjacent casing side wall, thus the inward sides edges of the jaws providing therebetween different spaces for insertion of cables having different diameters.

Still another object of the present invention is to provide a cable stopper of the above explained type wherein a lever means is attached to each of the jaws in an articulated manner which lever is arranged to shift the corresponding jaw in a direction along the casing longitudinal axis.

A further object of the present invention is to provide a cable stopper whose casing is of a hinge-like configuration and consists of two half-portions suspended on a joining stem parallel with the casing longitudinal axis, limitedly pivotable about this stem, where a gap is provided between the top walls of the half-portions of the casing and through said gap may be inserted between the clamping jaws.

A further object of the present invention is to provide the mentioned hinge-like casing having on its top side a pivotable lever means which is movable to abut the top walls of the casing half-portions, to cover the gap between their top walls and be ensured in this position, so that the top walls of the casing half-portions, together with the pivotable lever means, provide a continuous casing top wall preventing a cable inserted between the clamping jaws from slipping off, when the pivotable lever is in its closed position.

Still a further object of the present invention is to provide a cable stopper of the above described type which stopper contains lateral arms extending from the casing half-portions and carries on these arms attachment levers thereupon each of which levers are coupled by an articulated joining latch link to one of the clamping jaws and has coupled thereto pulling means such as tugs, connectable to a stationary support, so that these attachment levers, when actuated, force the clamping jaws via the articulated latch links to shift and thus to approach to one another and to squeeze therebetween a cable whose motion is to be prevented.

An additional object of the present invention is to provide on the casing a detent member operable by a pulling means which detent member ensures the closed position of the half-portions of the casing and the clamping jaws and which may be operated to disconnect the half-portions of the casing from one another and thus to relax the compression of a cable by the clamping jaws.

Accordingly, the inventive concept is concerned with achieving these and other beneficial objects by providing a cable stopper which has a pair of cable detaining jaws movable to approach from two sides one another and to squeeze therebetween a cable and thus to immobilize it.

The cable stopper of the construction of the present invention comprises a casing and clampable jaws housed in this casing. This casing has a top, a bottom and side walls and is configurated so that its top and bottom walls taper to one side of this casing, so that the same has a substantially trapezoidal cross-section. The side walls space from one another the bottom and top walls of the casing and have an elongated rectangular quadrilateral form.

Inside this casing, in a opposite relationship, a pair of clamping jaws is housed. The clamping jaws also have a tapering form and have inward edges extending along the longitudinal axis of the casing and distal slanting side edges extending along, and capable of sliding upon, the side walls of the casing, so that, when they are shifted, they are forced by the casing side walls to approach one another on their inward edges.

The casing is of a hinge-like configuration. It is composed of two half-portions connected by a joining stem extending parallel to the longitudinal axis of the casing. These half-portions are capable to limitedly pivot about this joining stem. The top walls of these half-portions of the casing leave therebetween a longitudinal gap wherethrough a cable may be inserted into the casing and between the clamping jaws. To one of these pivotable half-portions, a swingable lever means is attached on an axle joint extending parallel to the casing longitudinal axis. This lever means may be clamped down to cover the gap existing in the casing top wall and thus to prevent a cable to slip outwardly thereof.

This lever means also is arranged to be attachable to the other casing half-portion and thus to provide a coupling of the casing half-portions together to form a closed unit.

The casing extends at its broad side into lateral arms on which pivotable attachment levers are located. Each of these pivotable attachment levers is coupled by an articularly arranged latch link to one of the clamping jaws. Thus, pivoting of these levers causes shifts of the clamping jaws within the casing. Tug means are joined to these attachment levers to operate them. These tug means, in their turn may be coupled to a stationary support for anchoring the cable stopper. The force induced by this coupling is transmitted through the attachment levers via the articulated latch links onto the clamping jaws. By these forces, when these tugs are affixed to a stationary support, the clamping jaws are caused to move inwardly into the casing and, in moving so, to approach one another on their inward edges and to keep a cable inserted therebetween on these edges in a stopped position.

Thereby, guiding means are provided, such as a slot in each jaw parallel to its slanting edge and a shank engaged with this slot is provided inside each casing half-portion. These slots and shanks coact and force the clamping jaws to slide longitudinally of the casing and to remain during their shifts engaged on their distal slanting edges with the casing side walls. Thus, the longitudinally extending inward edges remain unchangeably aligned parallel to one another, so that in any position of the jaws the same are enabled to adhere on the entire lengths of their inward edges to a cable inserted therebetween.

The noval features which are considered as characteristic for the present invention are set forth, in particular, in the appended claims. The invention itself, however, both as its construction and method of operation are concerned, together with additional objects and advantages thereof, will be best understood from the following description of a specific embodiment when read in connection with the accompanying drawings.

DETAILED DESCRIPTION OF A PREFERRED EMBODIMENT

Figure 1:
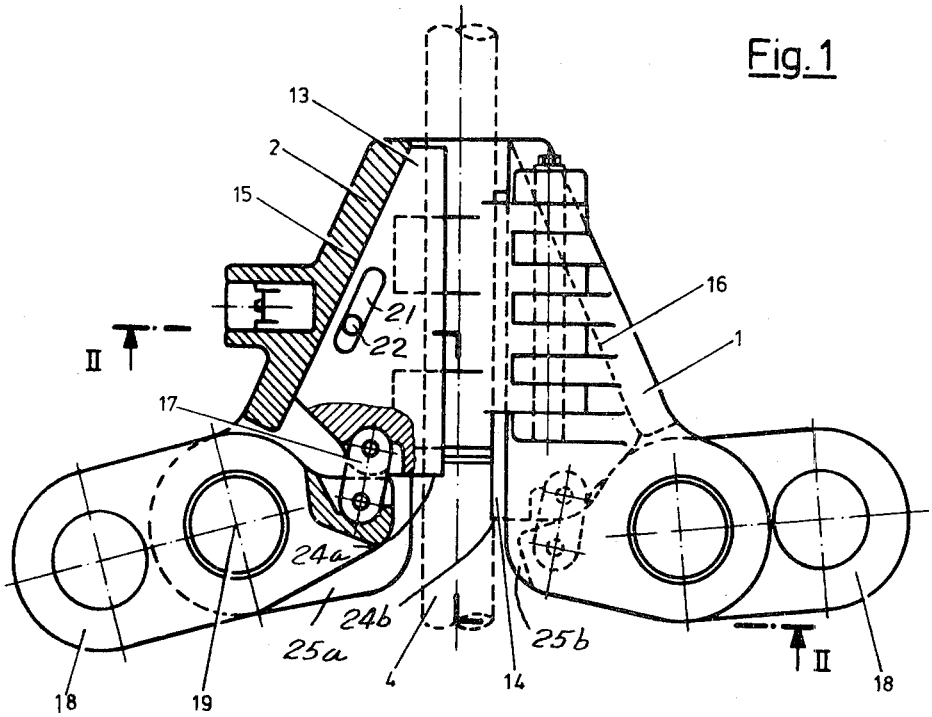
FIG. 1 shows the cable stopper according to the invention partially in a plan view and partially in a horizontal cross-sectional view.

FIG. 1 shows the casing of the cable stopper of the invention. This casing includes two half-portions 1 and 2 which are coupled to one another by a joining stem 3. The axis of this joining stem 3 is parallel to the direction in which a cable 4 may be inserted into the cable stopper of the invention.

Figure 2:
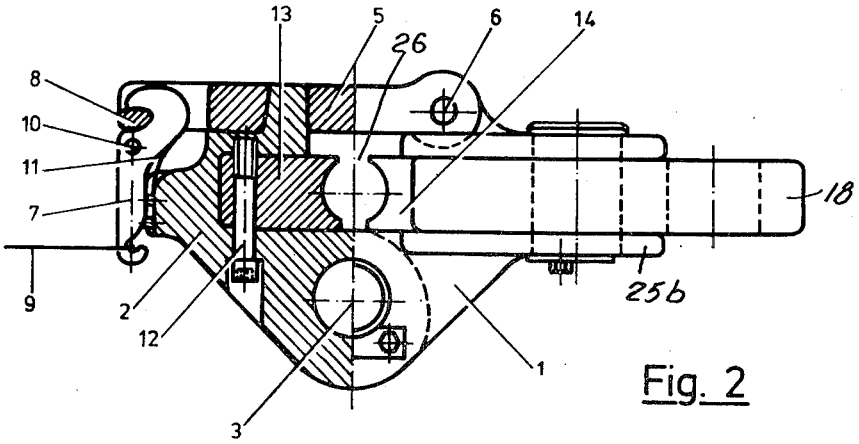
FIG. 2 illustrates the cable stopper of FIG. 1 in a cross-section taken along the line II—II marked in FIG. 1.

These casing half-portions 1 and 2, as is visible in particular from FIG. 2, have trapezoidal bottom and top walls which walls are connected to one another by elongated quadrilateral rectangular side walls, so that the top, bottom and side walls bound therebetween a free space extending longitudinally therethrough. The bottom walls form together a continuous bottom wall of the casing in which they are connected by their areas suspended on the joining stem.

The top walls of the casing half-portions 1 and 2 extend one toward the other and leave therebetween a longitudinal gap 26 parallel to the general longitudinal axis of the cable stopper.

Each of these casing half-portions 1 and 2 has on a plane extending longitudinally therewith a cross-section in the form of a right angle trapezoid tapering upwardly, and having a base, an internal side perpendicular to this base and a distal inclined side positioned at an acute angle to the base side, so that the casing half-portions 1 and 2 have a trapezoidal configuration tapering along the cable stopper general longitudinal axis.

Each of the casing half-portions 1 and 2 extends from the base of its trapezoidal form into a lateral arm **25*b*, 25*a*, respectively. On each of these lateral arms, an axle 19** normal thereto is arranged.

The construction of the cable stopper casing in this embodiment of the invention has a character of a hinge. The joining stem 3 is advantageously located parallel with and spacedly from, the place wherein a cable 4 is to be inserted.

About this joining stem 3, the two casing half-portions 1 and 2 may swing within a limited range. Thus in this configuration, the general longitudinal axis of the cable stopper casing extends parallel to the axis of the joining stem 3. The hinge-like arrangement of the casing is very important, as will be explained hereinafter, for both detaining in position or releasing a cable, such as that which in FIG. 1 is numbered as 4.

On the side remote from that where the joining stem 3 is located, i.e. on the top side of the cable stopper casing, a pivotable clamping lever 5 is arranged. This clamping lever 5 is substantially a one-arm lever or plate connected at one side thereof to the casing half-portions 1 by means of an axle joint 6 about which it may swing outwardly from the casing half-portions 1 and 2. This axle joint 6 of the pivotable clamping lever 5 also passes parallel to the casing general longitudinal axis.

It is apparent that this hinge-like construction of the casing half-portions 1 and 2, together with the pivotal arrangement of the clamping lever 5 permits lifting of this clamping lever 5 and a slight sideward swinging of the casing half-portions 1 and 2, so that, through the longitudinal gap 26 existing between the top walls of these casing half-portions 1 and 2, a cable 4 may be inserted into or withdrawn from the cable stopper casing.

At the side of the pivotable clamping lever 5 remote from the axle joint 6, this clamping lever 5 is provided with an upright bolt 8 extending parallel with the axle joint 6.

A detent member 7 is arranged proximate to this upright bolt 8. This detent member 7 is positioned and operative, so that it may coact with the clamping lever 5 in order to detain the same in a position in which this clamping lever extends from the casing half-portion 1 whereto it is attached parallel with and over the upper surface of the other casing half-portion 2. In this position this clamping lever 5 covers the gap 26 by which the top walls of these casing half-portions 1 and 2 are separated on their top sides from one another. When the detent member 7 is engaged with the upright bolt 8, the casing half-portions 1 and 2 are packed to each other, thus forming a closed unit of the cable stopper casing.

The detent member 7 is shown in this embodiment of the invention displayed by FIG. 2 as being a double-arm lever rotatably arranged on an axle stub 10 which projects from the casing half-portion 2. One arm of this double-arm detent member 7 extends toward the clamping lever 5 to the area where the latter carries the upright bolt 8. This end of the arm of the detent member 7 is formed as a hooked terminal arranged to be engageable on the upright bolt 8 of the pivotable clamping lever 5. It is preferable, for safety reasons in particular, to have the upright bolt 8 to project inwardly in order to engage there with the hooked terminal of the detent member 7.

The other arm of the double-arm detent member 7 is provided with a suitable means, such as a cutout, a hole or the like, whereto a pulling means 9, such as a cord or a bar, may be attached. By means of this pulling means 9, the pivotable detent member 7 may be swung to turn about its axle stub 10, so that, when it swings, it disengages the upright bolt 8 on the pivotable clamping lever 5 and disconnects from one another the casing half-portions 1 and 2, allowing them to widen the gap 26.

It is advantageous to provide such an interrelationship between the double arm detent member 7 and the upright bolt 8 on the pivotable clamping lever 5 that a plane interposed through the axle stub 10 and the contact area between the double-arm detent member 7 and the upright bolt 8 is tangential to a circular arc having its center in the axis of the joining stem 3. In this configuration, releasing of the pivotable clamping lever 5 requires an only relatively small pulling force exerted on the pulling means 9.

It is recommendable to provide a resilient backing for this detent member 7. This backing is provided, according to FIG. 2, by location behind this pivotable detent member 7 of a leaf spring 11 biasing this detent member in the direction wherein it returns to its condition in which it engages the upright bolt 8 and detains the pivotable clamping lever 5. During the releasing operation, the urging force of this leaf spring 11 must be overcome for effecting the release of the pivotable clamping lever 5.

Each of the casing half-portions 1 and 2 of the cable stopper houses one clamping jaw 13 and 14, respectively. These clamping jaws 13 and 14 are thus arranged in a pair wherein they oppose one the other. Each of these clamping jaws 13 and 14 is configurated as a right-angle triangular body having the form mating with that of the free space bound inside its corresponding casing half-portion 1 or 2 by this portion bottom, top and side walls. Each of the clampable jaws 13 and 14 has in this configuration a base edge 24*a*, 24*b*, an inward side edge extending at a right angle from this base edge and a distal side edge 15 or 16, respectively, parallel to the corresponding casing side wall, so that this side wall engages this distal side edge along its entire length. The clamping jaws 13 and 14 are sized so that their inward edges are spaced from each other. Each of these inward edges is preferably provided along its entire length with a longitudinal half-cylindrical groove to be capable of engaging a wide area of a cable inserted between these inward edges. However, other grooves or ribs may be provided on these edges for preventing a firm engagement with a cable surface.

As shown in FIG. 1, each clamping jaw 13 and 14 is provided with a guide slot 21 parallel to its respective distal side edge 15 and 16. A shank 22 extends perpendicularly from the wall of each casing half-portion 1 and 2 and is engaged with the guide slot 21. The slot 21, in coaction with the shank 22, guides each of the clamping jaws 13 and 14 so that it continuously adheres on its distal slanting side edge 15, 16 to the adjacent casing side wall and is supported thereby, irrespective of its shifting motion inside the respective casing half-portion 1 or 2. Thus, the inward side edges of the clamping jaws 13 and 14 are always parallel to one another, in spite of the forward or backward motion of the clamping jaws 13 and 14 in the direction of the casing general longitudinal axis. This is another important feature of the invented construction of the cable stopper, as will be explained hereinafter.

FIG. 1 also shows the clamping jaws 13 and 14 in two positions which they may assume. On the left side, the clamping jaw 13 is illustrated in its fully advanced position inside the cable stopper casing. It is quite apparent that, when the clamping jaw 13, as well as the clamping jaw 14, are in this advanced position, they provide therebetween a relatively narrow free space for a cable 4, so that they are capable of stopping a cable 4 having a relatively small diameter. On the other hand, in the illustration of the casing half-portion 1 on the right side of FIG. 1, the clamping jaw 14 is shown in a withdrawn position. When also the clamping jaw 13 is in this withdrawn position, a cable 4 of substantially larger diameter may be inserted and clamped between the clamping jaws 13 and 14. Thus, a versatility of the cable stopper is provided, and a wide range of cables of different diameters may be detained thereby.

Moreover, each of these jaws 13 and 14 is connected adjacent its base 24*a* and 24*b*, respectively, to a pivotable latch link 17. At the axle 19 of each lateral arm 25*a* and 25*b* of the casing half-portions 1 and 2, a swingable double-arm attachment lever 18 is provided which lever has an internal and an external arm. The latch link 17 of each jaw 13 and 14 is attached to one of the internal arms of the attachment lever 18 adjacent thereto and is pivotable thereupon. Therefore, a traction exerted on the external arm of this attachment lever 18 towards to the wider side of the casing, is transmitted in opposite direction onto the corresponding latch link 17 and produces a forward shift of the clamping jaw 13 and 14 along the longitudinal axis of the cable stopper. In effect of this traction, the jaws 13 and 14 slide along this axis on their distal side edges 15 and 16 on the forwardly slanting side walls of the casing half-portions 1 and 2. This shift results in a mutual approach of the upright inward edges of the jaws 13 and 14, thus narrowing the distance therebetween to a spacing in which they are enabled to squeeze from either side a cable 4 inserted therebetween and to detain it in a desired position. Thereby, these inward edges of the jaws 13 and 14 are unchangeably parallel to one another and to the general longitudinal axis of the cable stopper casing, and, due to this mutual relationship, compress therebetween a cable 4 along their entire lengths.

It is also apparent that by turning the lateral attachment levers 18, the clamping jaws 13 and 14 may provide therebetween a widened space, so that, in correspondence with the position of the clamping jaws 13 and 14, adjusted along the cable stopper casing general longitudinal axis, a spacing may be provided between these jaws 13 and 14 for a wide range of dimensions of cables 4.

To each of the swingable attachment levers 18, anchoring means for locally fixing the cable stopper may be connected.

Figure 3:
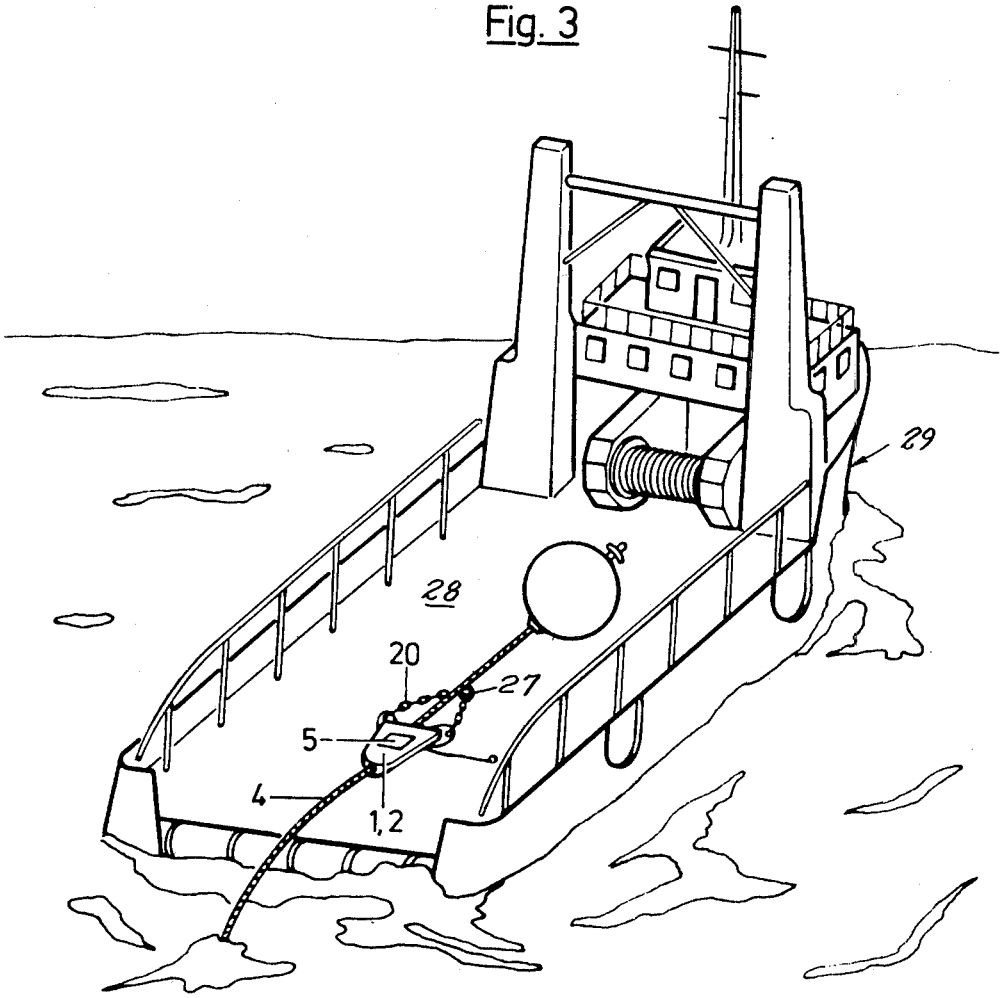
FIG. 3 shows the cable stopper of the invention in a perspective view when used on board of a ship.

FIG. 3 shows an example of how the cable stopper of the present invention may be employed. Here, short chain tugs 20 are provided having their free ends coupled to a ring 27 movably connected to the deck 28 of the ship 29 and having their other ends connected to one of the attachment levers 18. In this manner, there is created a triangular pulling force having its apex on this ring. Due to this connection, both the attachment levers 18 are pulled when the ring is attached to the stationary support of the ship's deck with identical force and the clamping jaws 13 and 14, via the latch links 17, are moved synchronically the same distance inside the cable stopper casing.

The pulling forces are exerted on the chain tugs 20 in consequence of suspension of the ring on a stationary support and of the motion of the cable 4 through the cable stopper casing. These forces are transmitted onto the clamping jaws 13 and 14 via the latch links 17, so that the same gradually engage and compress from either side a cable 4 inserted into the cable stopper and stop its motion. Thus, these pulling forces, exerted by the chain tugs 20 produe force components affecting the cable and detain it. Thereby, these forces also are determinative of the compression of the cable between the clamping jaws 13 and 14.

The continuous abutment of the slanting distal side edges of the clamping jaws 13 and 14 on the casing side walls ensures regularly distributed compressing forces between these clamping jaws 13 and 14 along the entire lengths thereof, so that a firm contact is established between the cable and the jaws.

While the invention has been illustrated and described as embodied in FIGS. 1 to 3, it is not intended to be limited to the details shown, since various modifications and structural changes may be made without departing in any way from the spirit of the invention.

It will be understood that each of the elements described above, or two or more together, may also find a useful application in other types of devices differing from the types described hereinabove.

Without further analysis, the foregoing will so fully reveal the gist of the present invention that others can, by applying current knowledge, readily adapt it for various applications, without omitting features that, from the standpoint of prior art, fairly constitute essential characteristics of the generic and specific aspects of this invention.

What is claimed as new and desired to be protected by Letters Patent is set forth in the appended claims.

1. A device for clamping and stopping elongated objects, particularly cables, comprising means defining a passage adapted to receive at least an elongated section of the object to be clamped and stopped, said means defining said passage being a casing having an equilateral trapezoidal configuration bounded by bottom and top walls spaced from each other by elongated rectangular side walls, said casing having on the wide lower and the narrow apex side thereof an aperture for passage of a cable; said casing having a hinge-like configuration formed by a pair of equal half-portions, suspended in their bottom walls on a joining stem parallel to the casing longitudinal axis and limitedly pivotable thereupon, so that said casing half-portions, in being pivoted on said joining stem, open between their top walls a longitudinal gap for insertion of a cable, at least two jaws located in said passage adjacent to said elongated section of the object to be clamped and stopped, said clamping jaws being arranged in a pair against one another within said casing, slidable therein and movable toward each other to clamp and stop therebetween a cable, each of said jaws having the form of a right-angled triangular body bounded by a base edge, a slanting distal edge parallel to the adjacent side wall of said casing, and an inward edge extending at right angle from said base edge, so that the inward edges of said jaws extend parallel to one another; means mounting said jaws in said casing for displacement toward and away from said elongated section to thereby clamp and release said elongated object, said mounting means including guide walls of said casing which converge in the longitudinal direction of said passage, and surfaces on said jaws which engage said casing guide walls, so that the jaws slide along said guide walls during said displacement; means for shifting said jaws in longitudinal direction inside said casing, so that the shift of said jaws toward the apex region of said casing causes said jaws to slide on their slanting distal edges along said casing guide walls, to approach one another on their inward side edges and thus to provide in various longitudinal positions thereof different spacings between each other to compress along their entire lengths from either side cables of various diameters, said shifting means being lateral double-arm levers pivotally attached to said casing, each having an internal and an external arm, each being coupled on its internal arm to one of said jaws proximate thereto, so that the actuating of the corresponding one of said external arm produces motion of the corresponding one of said jaws in the longitudinal direction of said casing, each of said external arms being provided with a means for attachment thereto of an actuating means, said actuating means being a tug coupled at one end thereof to each of said attachment means and provided at the other end thereof with a looped means for its connection to a stationary support structure providing local anchoring of said casing, the tugs having said connecting looped means in common.

2. A cable stopper as defined in claim 1, wherein said top walls of said casing half-portions leave therebetween a longitudinally extending gap, also in closed condition thereof.

3. A cable stopper as defined in claim 2, wherein a lever means is pivotally arranged on an axle joint extending parallel to said casing longitudinal axis and attached to one of said casing half-portions, said lever means extending across said gap and being provided with coupling means at its side distant from said axle joint, so that said lever means is enabled to transverse said gap and ensure, in being coupled to said other casing half-portion, a fixation of both said casing half-portions in a correct mutual positions.

4. A cable stopper as defined in claim 3, wherein said lever means is a plate.

5. A cable stopper as defined in claim 3, wherein said coupling means is an upright bolt extending from said lever means and a pivotable detent member attached on an axle stub to said other casing half-portion, said detent member extending perpendicularly to said lever means, being located proximate to said upright bolt and being engageable with said bolt to ensure said lever means in its fixed position.

6. A cable stopper as defined in claim 5, wherein said upright bolt extends from said lever means inwardly.

7. A cable stopper as defined in claim 5, wherein said detent member is provided at its end proximate to said upright bolt with a hooked terminal engageable with said upright bolt.

8. A cable stopper as defined in claim 7, wherein said detent member is a double-arm lever, is provided with said hooked terminal at its end proximate to said upright bolt and has the other arm thereof available for actuation on causing disengagement of said detent member from said upright bolt.

9. A cable stopper as defined in claim 8, wherein a springing backing means is located behind said detent member, said backing means being adapted to urge said detent member into its position in which it is engaged with said upright bolt.

10. A cable stopper as defined in claim 8, wherein said springing backing means is a leaf spring.

11. A cable stopper as defined in claim 10, wherein said actuating means is a long rod.

12. A cable stopper as defined in claim 8, wherein actuating means is attached to said other arm of said detent member for causing pivoting thereof and its disengagement from said upright bolt.

13. A cable stopper as defined in claim 12, wherein said actuating means is a long cord.

14. A cable stopper as defined in claim 13, wherein said detent member and said upright bolt are positioned in such an interrelationship that a plane interposed between said axle stub and the contact area between said detent member and said upright bolt is tangential to a circular arc having its center on the axis of said joining stem, so that releasing which disengages said detent member from said upright bolt requires a relatively small pulling force.

15. A device for clamping and stopping elongated objects, particularly cables, comprising a hinge-like configured casing comprising a pair of half-portions defining a passage adapted for the insertion of a cable; a detent member; a clamping lever at one end connected pivotally to said casing and the other end arranged proximate to said detent member so as to permit the half-portions to be driven towards each other by engaging said detent member; a pair of clamping jaws arranged in both of the half-portions so that said jaws oppose each other; means mounting said jaws in said casing for slidable displacement toward and away from the cable so as to stop the cable; a plurality of attachment levers, each pivotally connected to one of said respective jaws so as to produce a forward shift of said jaws as the attachment levers are drawn; and an actuating means connected to said attachment levers, wherein said hinge-like casing comprises an equilateral trapezoidal configuration bound by bottom and top walls spaced from each other by elongated rectangular side walls, a wide, lower and apex side with a passage for the insertion of a cable, said pair of jaws each having the form of a right-triangular body bounded by a base edge, a slanting distal edge parallel to the adjacent side wall of said casing, and an inward edge extending at right angle from said base edge so that the inward edges of said jaws extend parallel to one another.

16. A device as defined in claim 15, further comprising cable catching means provided on each of said inward side edges of said jaws for ensuring an effective engagement with a cable inserted between said jaws.

17. A device as defined in claim 16, further comprising a half-cylindrical groove extending along the entire length of each of said inward side edges of said jaws.

18. A device as defined in claim 15, wherein said attachment levers are laterally double-armed and pivotally connected to said casing, each lever having an internal and an external arm and each lever being coupled on its internal arm to more proximate of said jaws so that the actuating of the external arms produces motion of the corresponding jaw in the longitudinal direction of said casing.

19. A device as defined in claim 18, further comprising a latch link pivotally attached to both the internal arm and said jaw so that each internal arm of the double-armed lever is coupled to its corresponding jaw.

20. A device as defined in claim 18, further comprising a longitudinal guide slot extending parallel to a distal slanting side edge of said jaws, and a shank extending into said slot from a position opposite said slot so that the coaction of said guide slots and said shanks ensures a continuous sliding of said distal slanting side edges of each of said clamping jaws along the proximate casing side wall in a close engagement therewith and thus a constant alignment of said inward side edges of said jaws in a parallel relationship.

* * * * *